United States Patent [19]

Maruyama et al.

[11] 4,249,106

[45] Feb. 3, 1981

[54] RADIATION SENSITIVE SCREEN

[75] Inventors: Eiichi Maruyama, Kodaira; Saburo Ataka, Hinodemachi; Kiyohisa Inao, Mobara; Yoshinori Imamura, Hachioji; Toshihisa Tsukada, Sekimachi; Yukio Takasaki, Hachioji; Tadaaki Hirai, Koganei, all of Japan

[73] Assignee: Hitachi, Ltd., Japan

[21] Appl. No.: 92,021

[22] Filed: Nov. 7, 1979

[30] Foreign Application Priority Data

Nov. 8, 1978 [JP] Japan ..... 53-136805
Jan. 31, 1979 [JP] Japan ..... 54-10059[U]

[51] Int. Cl.³ ..... H01J 29/45

[52] U.S. Cl. ..... 313/365; 313/94; 250/315.1; 250/370

[58] Field of Search ..... 250/486, 483, 369, 370, 250/213 VT, 315.1; 313/94, 365, 366

[56] References Cited

U.S. PATENT DOCUMENTS 3,890,524 6/1975 Watanabe et al. ..... 313/94
3,890,525 6/1975 Hirai et al. ..... 313/94

*Primary Examiner*—Bruce C. Anderson
*Attorney, Agent, or Firm*—Craig & Antonelli

[57] ABSTRACT

A radiation sensitive screen comprising a crystalline silicon substrate which is located on a side of incidence of radiation, and an amorphous silicon film which contains hydrogen and which is located on the opposite side of the substrate to the side of the incidence of the radiation. The radiation sensitive screen of this invention can be manufactured by a simple method, and can achieve a high resolution. It is useful for the target of an image pickup tube, the electron bombardment target of an X-ray fluorescence multiplier tube, etc.

7 Claims, 8 Drawing Figures

RADIATION SENSITIVE SCREEN

BACKGROUND OF THE INVENTION

1. Field of the Invention

This invention relates to a novel radiation sensitive screen.

2. Description of the Prior Art

As a typical example of sensitive screens to be used in the storage mode, there has heretofore been the target of a photoconductive pickup tube shown in FIG. 1. This tube is made up of a light transmitting substrate 1 usually termed the faceplate, a transparent conductive film 2, a photoconductor layer 3, an electron gun 4 and an envelope 5. The optical image of incident light 7 formed on the photoconductor layer 3 through the faceplate 1 is subjected to photoelectric conversion and stored in the surface of the photoconductor layer 3 as a charge pattern. The stored charges are read in time series by the use of a scanning electron beam 6.

An important property required of the photoconductor layer 3 at this time is that the charge pattern does not vanish due to diffusion within the time interval in which a specified picture element is scanned by the scanning electron beam 6 (in other words, the storage time). As the materials of the photoconductor layer 3, accordingly, there are ordinarily employed semiconductors whose specific resistances are at least $10^{10}\Omega$.cm, for example, $Sb_2S_3$-, PbO- or Se-based chalcogen glass. In case of employing a material such as Si single crystal whose specific resistance is lower than $10^{10}\Omega$.cm, the surface of the photoconductor layer on the electron beam scanning side needs to be divided into the mosaic so as to prevent the vanishing of the charge pattern. Among these materials, the Si single crystal involves a complicated working process. The high resistivity semiconductors are inferior in the photo-response characteristics because they usually contain at high densities trap levels impeding the transit of photo-carriers. The imaging device is accordingly apt to the drawback that a long decay lag or an after-image develops.

The following references are cited to show the state of the prior art:

(1) Weimer et al., Electronics, 23, 5 (1950)

(2) Weimer et al., RCA Rev., 12, 314 (1951)
The above references concern vidicons.

(3) Singer, B., IEEE Trans., ED-18, 11, 1016 (1971)
This relates to a silicon vidicon tube.

(4) Miyashiro, S. et al., IEEE Trans., ED-18, 11, 1023 (1971)
This relates to a silicon electron multiplication camera tube.

(5) S.M. Blumenfeld et al., IEEE Trans., ED-18, 11, 1036 (1971)
This relates to an epitaxial diode array vidicon.

SUMMARY OF THE INVENTION

This invention intends to eliminate the disadvantages described above. An object of this invention is to provide a sensitive screen which is applicable to photo-sensors of the storage mode exhibiting high resolutions, etc. Further, the sensitive screen according to this invention undergoes the after-image very little and is favorable in the decay lag characteristics. In addition, the manufacturing method of the sensitive screen is simple.

The fundamental construction of this invention is as stated below.

The sensitive screen of this invention can be applied to the reception of infrared rays, visible rays, electron rays, etc. These incident light and electron rays, etc. shall be simply termed "radiation" here in this specification.

FIG. 2 shows a plan view of a sensitive screen, and FIG. 3 a sectional view taken along A—A' in FIG. 2. An ohmic electrode 21 is disposed on a part of a silicon single-crystal substrate or polycrystalline substrate 20. In this specification, both the substrates shall be simply referred to as "silicon crystal substrate". If necessary, the electrode may well be provided on the entire surface of the silicon crystal substrate on the side which the radiation enters. However, this electrode layer is desirably disposed in the ring form on the peripheral edge of the silicon crystal substrate in order to avoid its absorption of the radiation such as light and electron rays. On the side of the silicon crystal substrate 20 opposite to the surface which the radiation enters, an amorphous silicon layer 22 containing hydrogen is formed. The amorphous silicon layer containing hydrogen is usually higher in the electric resistance than the silicon crystal substrate, and is suited as the charge storing layer of a photo-sensor of the storage mode. In the present sensitive screen, the energy of the incident radiation is absorbed by the silicon crystal substrate 20 and generates conductive carriers, which are injected into the amorphous silicon layer 22 to be stored in the surface thereof and to become a charge pattern. This charge pattern can be taken out as electric signals by charge readout means, for example, the scanning of an electron beam as in an image pickup tube.

Although the thickness of the sensitive portion of the silicon crystal substrate 20 varies depending upon the intended use of the sensitive screen, a value of 5–30 $\mu$m is suitable for the pickup of an image of the visible light or high-speed electron rays, and a value of 30–100 $\mu$m for the reception of the infrared region. In case where the incident radiation is light, it is possible to form the silicon crystal substrate on a light-transmitting supporting plate. However, in case where the incident radiation is electron rays, the silicon crystal substrate must be of the self-support type in order to avoid the decrease of the transmission factor attributed to the supporting plate, and the mechanical strength of the substrate needs to be increased by providing a ring-shaped thick part as in FIG. 3. In general, a value of 200–300 $\mu$m is suitable as the thickness of the thick-walled part.

The thickness of the amorphous silicon layer 22 containing hydrogen is favorably set at 1–10 $\mu$m. From the standpoint of reducing the capacitive lag as in the image pickup tube, it is desirable that the layer is thick. However, when it is too thick, the transit of the injected carriers becomes difficult. Consequently, the required electric field rises, and the difficulty in the use of the sensitive screen increases. Preferable as the hydrogen content of the amorphous silicon is 5–40 at.-%. When the hydrogen density is below the specified range, the specific resistance of the amorphous silicon layer becomes lower than $10^{10}\Omega$.cm and is unsuitable for the photoconductive screen of the storage type image pickup tube. When the hydrogen density increases beyond the specified range, the difference of the specific resistance of the amorphous silicon layer from that of the silicon crystal substrate becomes conspicuous, and the efficiency at which the conductive carriers generated in the silicon crystal substrate are injected into the amorphous silicon layer degrades to lower the sensitivity.

The hydrogen contents of the amorphous silicon, and the respective characteristics of sensitivity, resolution and exfoliation are listed as in the following Table 1:

TABLE 1

| Hydrogen content (at.−%) | Sensitivity | Resolution | Exfoliation |
|---|---|---|---|
| 0 | bad | bad | existent |
| 5 | good | medium | nonexistent |
| 10 | good | good | nonexistent |
| 20 | good | good | nonexistent |
| 30 | good | good | nonexistent |
| 40 | medium | medium | nonexistent |
| 50 | bad | bad | existent |

The inventors have found out that an amorphous material which contains silicon and hydrogen simultaneously has the following advantages and is extraordinarily favorable for use in the imaging sensitive screen. (1) The amorphous material can be readily put into a high resistivity of at least $10^{10}\Omega$.cm by controlling the content of hydrogen. (2) Moreover, since the number of traps hampering the transit of photo-carriers is small, the after-image occurs little and the decay lag characteristics are good. (A specific resistance on the order of $10^{14}\Omega$.cm will be the upper limit in practice.) Such natures can be noted also in case where some impurity, for example, carbon, germanium, boron or phosphorus is contained in the amorphous material which contains silicon and hydrogen simultaneously. When carbon is contained, the specific resistance of the amorphous material rises, and when germanium is contained, it lowers. In particular, germanium is useful for controlling the spectral response. In an Si-Ge-based amorphous material containing hydrogen, germanium is often contained to the extent of 10–50 at.-% with respect to silicon.

Boron and phosphorus are effective as impurities for bringing the conductivity of the amorphous material towards the p-type and the n-type respectively. These impurities are appropriately used in a range of approximately $1\times10^{-3}\%$ to 1% as may be needed.

Some oxygen is liable to be contained during the manufacture of the amorphous material.

Since the surface of the sensitive screen of the present structure to be scanned by an electron beam is liable to increase the dark current on account of secondary electrons generated by the bombardment with the scanning electron beam or on account of the injection of the scanning electron beam, it is desirably covered with a thin film of a suitable material in advance. Suitable as the materials of such beam landing layer are $Sb_2S_3$, $CeO_2$, $As_2Se_3$, etc. In particular, a thin porous film of $Sb_2S_3$ evaporated to a thickness of about 100 nm exhibits good characteristics.

The advantages of this invention are as follows:

(1) Since the amorphous silicon layer 22 exists as the charge storing layer of high resolution, it is unnecessary to form the mosaic structure preventive of the lateral diffusion of charges on the electron beam scanning side as in the prior-art silicon target. Accordingly, the sensitive screen is structurally simplified.

(2) At the same time, the resolution is enhanced.

(3) In case where intense incident light has entered, the prior-art silicon target undergoes the image diffusion called "booming" on account of the short-circuit between picture elements caused by the diffusion of charges. In the target of the present structure, neither such phenomenon nor the after-image due to intense light takes place.

(4) The sensitive screen of the present structure does not require the supporting substrate as in the prior-art $Sb_2S_3$ sensitive screen or PbO sensitive screen, and can be made the self-support type. It is therefore suitable as sensitive screens, not ony for optical images, but also for radiation images of electron rays etc.

(5) The capacitance of the sensitive screen is not determined by the capacitance of a p-n junction as in the case of the prior-art silicon target pickup tube, but it is determined by the capacitance of the amorphous silicon film. The capacitive lag can therefore be reduced by appropriately selecting the thickness of the amorphous silicon film.

(6) Since the crystalline silicon substrate is overlaid with the amorphous silicon layer of the same sort, the bonding property between both these constituents is better than in case of disposing any other photoconductor layer.

(7) The amorphous silicon layer 22 can be formed by the decomposition of silane utilizing the glow discharge, the sputtering of silicon in an atmosphere containing hydrogen, the electron beam evaporation, or the like. Accordingly, the manufacturing method is very simple.

DETAILED DESCRIPTION OF THE PREFERRED EMBODIMENTS

Before describing concrete examples according to this invention, methods of manufacturing an amorphous material for use in this invention will be explained.

The sputtering process which is the most typical will be first referred to.

Figure 5:
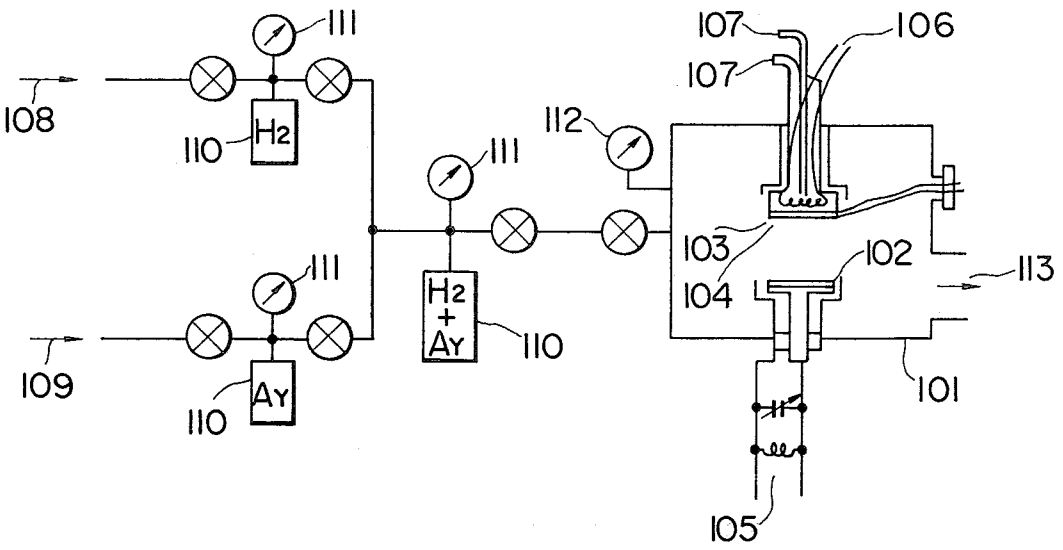
FIG. 5 is an explanatory view of an equipment for forming an amorphous silicon film.

FIG. 5 shows a model diagram of an equipment for the reactive sputtering. The equipment itself is a conventional sputtering equipment. Numeral 101 designates a vessel which can be evacuated to vacuum, numeral 102 a sputtering target, numeral 103 a sample substrate, numeral 104 a shutter, numeral 105 an input from a sputtering radio frequency oscillator, numeral 106 a heater for heating the substrates, numeral 107 a cooling water-pipe for the substrates, numeral 108 a port for introducing hydrogen of high purity, numeral 109 a port for introducing a gas such as argon, numeral 110 a gas container, numeral 111 a pressure gauge, numeral 112 a vacuum gauge, and numeral 113 a connection port to an evacuating system.

As the sputtering target, one obtained by cutting out fused silicon may be employed. In case of an amorphous material which contains silicon and germanium and/or carbon, a target having the three sorts of group-IV elements combined is employed. In this case, the target is conveniently prepared by, for example, placing a slice of graphite or germanium on a silicon substrate. By appropriately selecting the areal ratio between the silicon and the germanium or carbon, the composition of the amorphous material can be controlled. It is of course allowed to dispose, for example, a silicon slice on a carbon substrate conversely. Further, the target may well be constructed by juxaposing both the materials or by employing the melt of the composition.

When silicon (Si) which is caused to contain, for example, phosphorus (P), arsenic (As) or boron (B) in advance is used as the target for sputtering, such element can be introduced as an impurity element. With this method, an amorphous material of any desired conductivity type such as n-type and p-type can be produced. Besides, the resistance value of the material can be varied by the doping with such impurity. Even a high resistivity on the order of $10^{13}\Omega$.cm can be realized. Such impurity-doping can also resort to a method of mixing diborane or phosphine in a rare gas.

Using the equipment as described above, radio-frequency discharge is caused in an argon (Ar) atmosphere which contains hydrogen ($H_2$) at various mixing ratios, to sputter the Si and graphite and to deposit them on the substrate. Thus, a thin layer is obtained. In this case, the pressure of the Ar atmosphere containing hydrogen may be any value within a range in which the glow discharge can be sustained. Usually, the value is approximately $10^{-3}-1$ Torr. The pressure of hydrogen may be in a range of $10^{-4}-10^{-1}$ Torr, and it is a favorable example to make the partial pressure of hydrogen 2–50%. The temperature of the sample substrate may be selected in a range of from the room temperature to 300° C. Temperatures of approximately 150°–250° C. are the most practical. The reason is that at too low temperatures, the introduction of hydrogen into the amorphous material is difficult, while at too high temperatures, hydrogen tends to be emitted from the amorphous material contrariwise. The hydrogen content is controlled by controlling the partial pressure of hydrogen in the Ar atmosphere. In case where the quantity of hydrogen in the atmosphere is made 5–20%, a content of about 10–30 atomic-% can be realized in the amorphous material. Regarding other compositions, the partial pressure of hydrogen may be set with the aim roughly fixed to this proportion. As regards the hydrogen component in the material referred to later, hydrogen gas produced by heating was measured by the mass spectrometry.

The Ar being the atmosphere can be replaced with another rare gas such as krypton (Kr).

In obtaining a film of high resistivity, a low-temperature high-speed sputtering equipment of the magnetron type is favorable.

The second method for manufacturing the amorphous material of this invention is one which employs the glow discharge. By subjecting $SiH_4$ to the glow discharge, the substance $SiH_4$ is decomposed to deposit the constituent elements on a substrate. In case of an amorphous material containing Si and C, a gaseous mixture consisting of $SiH_4$ and $CH_4$ may be used. In this case, the pressure of the gaseous mixture consisting of $SiH_4$ and $CH_4$ is held at a value between 0.1 and 5 Torr. The glow discharge may be established either by the d.c.-bias method or by the r.f.-discharge method. By varying the ratio of $SiH_4$ and $CH_4$ which constitute the gaseous mixture, the proportion of Si and C can be controlled.

Now, this invention will be described in detail in connection with concrete examples.

EXAMPLE 1

Figure 4:
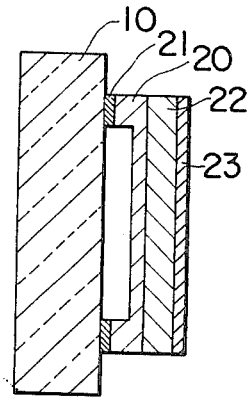
FIG. 4 is a sectional view of an embodiment.
Figure 3:
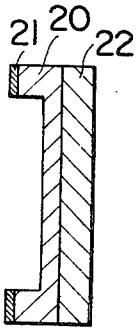
FIGS. 2 and 3 are plan view and a sectional view of a sensitive screen according to this invention, respectively.
Figure 2:
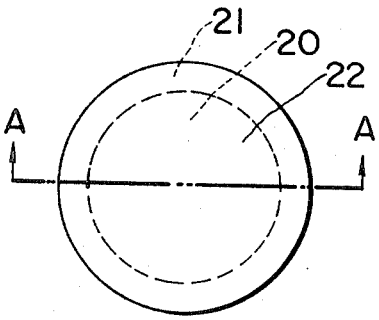

This example will be described with reference to FIG. 4.

A ring-shaped electrode 21 was formed on the peripheral edge of a glass substrate (2.5 mm in thickness, 13 mm in radius) 10. The electrode was made of chromium, and had a thickness of about 500 nm. On the other hand, a circular silicon crystal having a thickness of 200 μm and a radius of 11 mm and its part of an inside diameter of 20 mm etched down to a thickness of 15 μm with fluoric and nitric acids. Apiezone wax could be satisfactorily employed for a mask for the etching. The silicon crystal 20 thus prepared was bonded onto the electrode 21 with silver paste.

Subsequently, the resultant glass body was installed in a sputtering equipment. The equipment was as explained with reference to FIG. 5. Under an Ar pressure of $5\times10^{-3}$ Torr and a partial hydrogen pressure of $1\times10^{-3}$ Torr, silicon was deposited by sputtering. The frequency was 13.56 MHz, and the input power was 300 W. As a result, an amorphous silicon film 22 having a hydrogen content of 25 at.-% could be formed to a thickness of 3 μm. Further, an $Sb_2S_3$ film 23 as a beam landing layer was evaporated and formed on the amorphous silicon film to a thickness of 100 nm in Ar under $5\times10^{-2}$ Torr.

In this way, a sensitive screen for photoelectric conversion could be fabricated.

Figure 1:
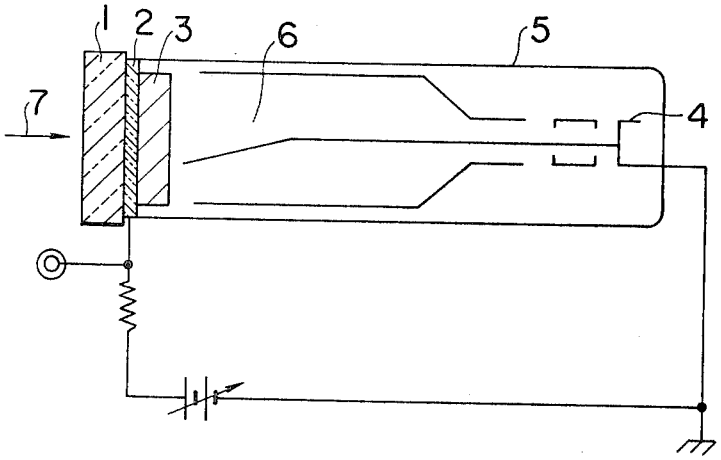
FIG. 1 is a sectional view of a photoconductive pickup tube which is a typical example of storage type photo-sensors.

The sensitive screen was installed as a target in an image pickup tube as shown in FIG. 1, and the characteristics of the tube were tested. Then, the good results of a white light sensitivity of 0.1 μA/lux, a limit resolution of 900 TV lines, a decay lag of less than 1 second, an after-image of 9%, and nonexistence of blooming were obtained at a target voltage of 30 V. The spectral response of the image pickup tube had its peak at a wavelength of 1.1 μm, and substantially agreed with that of the crystal silicon.

Even when a polycrystalline plate is employed as the silicon substrate, similar effects can be achieved with regard to the charge storage into the amorphous silicon layer. Needless to say, however, the use of the single-crystal plate is more preferable in that uniformity in a picture is not adversely affected by the grain boundary.

EXAMPLE 2

Figure 6:
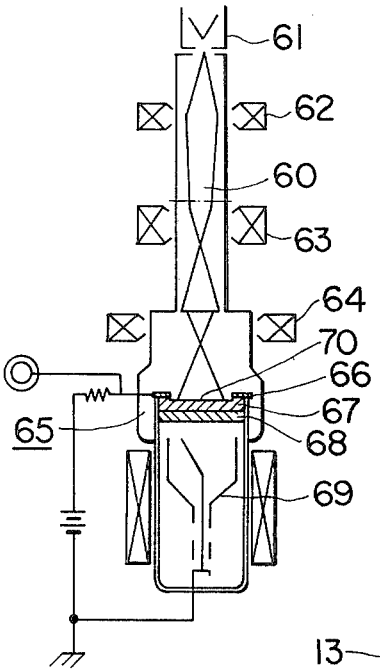
FIG. 6 is a view for explaining an example in which the sensitive screen of this invention is adopted for the reception of electron rays.

There will be explained an example in which a sensitive screen of this invention is employed for the reception of electron rays. FIG. 6 is an explanatory view of this example. Numeral 61 indicates an electron gun, and numerals 62, 63 and 64 indicate a condenser lens, an objective lens and a projection lens. All these components are the same as in the construction of a conventional electron microscope. Numeral 60 designates a sample, and numeral 70 the final image of this sample. The sensitive screen 65 of this invention is installed on the position of the final image. In this manner, charges stored in the sensitive screen were taken out as electric signals by electron beam-scanning means as in the image pickup tube.

The sensitive screen was constructed as follows.

A circular silicon crystal having a thickness of 200 μm and a radius of 11 mm had its part of an inside diameter of 20 mm etched down to a thickness of 5 μm. On the rear surface of the silicon crystal, an amorphous Si-Ge alloy (in which the quantity of Ge was 10 atomic-%) was sputtered to a thickness of 2 μm by the use of a magnetron type sputtering equipment. The Ar pressure during the sputtering was $8\times10^{-3}$ Torr, and the partial hydrogen pressure was $3\times10^{-3}$ Torr. A $CeO_2$ film was further deposited on the amorphous Si-Ge alloy to a thickness of 50 nm in Ar under $7\times10^{-2}$ Torr.

The electron beam scanning means as in the image pickup tube was mounted on the hydrogen-containing amorphous Si-Ge film side of the above sensitive screen. The silicon crystal substrate 67 as well as the hydrogen-containing silicon-germanium amorphous film 68 was placed on a signal electrode 66 which was a ring-shaped metal plate. The resultant imaging portion utilized the metal plate 66 as its baseplate, and a vessel containing the electron beam scanning means was sealed.

Shown at 69 is a scanning electron gun. The interior of a body tube was evacuated to $5\times10^{-6}$ Torr, and the high-speed electron-ray image 70 under an acceleration voltage of 180 KV was formed on the silicon crystal surface 67. The side of the $CeO_2$ surface was scanned with a low-speed electron beam by the electron gun. The current gain obtained at this time reached $5\times10^3$. In this way, it was verified that the present sensitive screen is useful as an electron multiplication type target.

EXAMPLE 3

There will be described an example in which a sensitive screen of this invention is applied to the electron bombardment target of an X-ray fluorescence multiplier tube.

Figure 7:
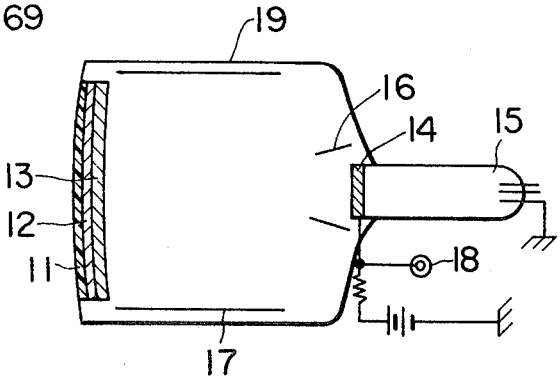
FIG. 7 is a view for explaining an example in which the sensitive screen of this invention is applied to a direct-conversion type image intensifier.

FIG. 7 is a sectional explanatory view of the X-ray fluorescence multiplier tube. Except an output portion, it is fundamentally the same as a conventional device. An input screen is disposed inside an envelope 19 on the input side thereof, the envelope being mainly made of glass or the like. The input screen is so constructed that an input phosphor screen 12 is formed on the output side of a substrate 11 which is ordinarily made of aluminum or glass, and that a photoelectric layer 13 is formed on the input phosphor screen. The input phosphor screen 12 uses cesium iodide or the like alkali halide as a parent substance, in which Na, Li, Tl or the like is usually contained as an activator. Ordinarily, the input phosphor screen has a thickness of about 100–500 μm. In general, the photoelectric layer 13 is a cesium-antimony-based photoelectric layer and has a thickness of approximately 1 μm or less.

An anode 16 and the electron bombardment target 14 are disposed inside the envelope 19 on the output side thereof. Further, a focusing electrode 17 is disposed inside the envelope 19 in a manner to extend along the side wall thereof. The interior of the envelope 19 is, of course, held in vacuum. Further, an electron gun or the like 15 as means for taking out stored charges is disposed in opposition to the electron bombardment target 14. The electron gun may be a conventional one of the vidicon type.

In this manner, in the present example of application, photo-electrons generated just as in the conventional X-ray fluorescence multiplier tube are caused to impinge against the electron bombardment target with the focusing electrode and are directly converted into electric signals.

Figure 8:
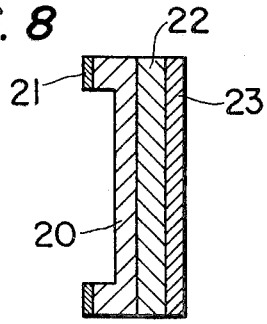
FIG. 8 is a sectional view of an example of an electron bombardment target.

FIG. 8 shows the sectional construction of the electron bombardment target 14. The target is ordinarily circular. An ohmic electrode 21 is disposed on a part of a silicon single-crystal substrate or polycrystalline substrate 20. This electrode is provided in a ring shape in the peripheral edge of the silicon crystal substrate in order to avoid the absorption of electron rays by the electrode layer. An amorphous semiconductor layer 22 containing hydrogen is formed on the rear side of the silicon crystal substrate 20 opposite to the input surface thereof. The amorphous semiconductor layer is made of amorphous silicon, amorphous silicon containing germanium, or the like.

Since the surface of the target of the present structure on the electron beam scanning side is apt to increase the dark current due to the generation of secondary electrons by the bombardment with the scanning electron beam or due to the occurrence of the injection of the scanning electron beam, it is desirably covered with a thin film 23 of a suitable material. Such materials are $Sb_2S_3$, $CeO_2$, $As_2Se_3$, etc., and especially a thin porous film of $Sb_2S_3$ evaporated to a thickness of about 100 nm exhibits good characteristics.

Now, the electron bombardment target will be described in detail in connection with a concrete example.

A circular silicon crystal having a thickness of 200 μm and a radius of 11 mm had its part of an inside diameter of 20 mm etched down to a thickness of 15 μm with fluoric and nitric acids. Apiezone wax could be satisfactorily employed for a mask for the etching. The silicon crystal 20 thus prepared was bonded onto the electrode 21 with silver paste.

Subsequently, the glass body thus prepared was installed in a sputtering equipment. Under an Ar pressure of $5\times10^{-3}$ Torr and a partial hydrogen pressure of $1\times10^{-3}$ Torr, silicon was deposited by sputtering. The frequency was 13.56 MHz, and the input power was 300 W. As a result, an amorphous silicon film 22 having a hydrogen content of 25 at.-% could be formed to a thickness of 3 μm. Further, an $Sb_2S_3$ film 23 was evaporated and formed on the amorphous silicon film to a thickness of 100 nm in Ar under $5\times10^{-2}$ Torr.

In this way, an electron bombardment target could be fabricated.

A vidicon type electron gun 15 was disposed in opposition to the electron bombardment target. An external terminal 18 was led from the electrode 21. The target voltage was, for example, approximately 30 V.

An example of hydrogen-containing amorphous Si-Ge film as a target will be described.

A circular silicon crystal having a thickness of 200 μm and a radius of 11 mm had its part of an inside diameter of 20 mm etched down to a thickness of 5 μm. On the rear surface of the silicon crystal, an amorphous Si-Ge alloy (in which the quantity of Ge was 10 atomic-%) was sputtered to a thickness of 2 μm by the use of a magnetron type sputtering equipment. The Ar pressure during the sputtering was $8.5\times10^{-3}$ Torr, and the partial hydrogen pressure was $3\times10^{-3}$ Torr. A $CeO_2$ film was further deposited on the amorphous Si-Ge alloy to a thickness of 52 nm in Ar under $7\times10^{-2}$ Torr.

The electron beam scanning means as in the image pickup tube was mounted on the hydrogen-containing amorphous Si-Ge film side of the above sensitive screen.

In this manner, the direct-conversion type image intensifier which has the input phosphor film, the photoelectric layer and the electron bombardment target is fabricated. When a d.c. voltage of 25 KV is applied across the photoelectric layer (cathode) and the anode and a d.c. voltage of 100–200 V is applied to the focusing electrode, an X-ray image is taken out as video signals. Regarding the performance, the conversion coefficient becomes 200 $cd/m^2/mR/S$ and the resolution becomes 5.0 $l_p$/mm. Therefore, the X-ray image intensifier according to this invention is higher in sensitivity and resolution than a conventional one.

What is claimed is:

1. A radiation sensitive screen comprising a crystalline silicon substrate which is located on a side of incidence of radiation, and an amorphous silicon film which contains hydrogen therein and which is located on a side of said substrate opposite to said side of the incidence of the radiation.

2. A radiation sensitive screen according to claim 1, wherein a hydrogen content of said amorphous silicon film containing hydrogen therein is 5 atomic-% to 40 atomic-%.

3. A radiation sensitive screen according to claim 2, wherein 10% to 50% of silicon in said amorphous silicon film is substituted by germanium.

4. A radiation sensitive screen according to claims 1 to 3, wherein a thickness of said amorphous silicon film containing hydrogen therein is 1 μm to 10 μm.

5. A radiation sensitive screen according to claims 1 to 3, wherein a thickness of a sensitive portion of said crystalline silicon substrate is 5 μm to 30 μm.

6. A radiation sensitive screen according to claims 1 to 3, wherein a thickness of a sensitive portion of said crystalline silicon substrate is 30 μm to 100 μm.

7. A radiation sensitive screen according to claims 1 to 3, wherein a beam landing layer is disposed on said amorphous silicon film.

* * * * *